US006247805B1

(12) United States Patent
Iwaya

(10) Patent No.: US 6,247,805 B1
(45) **Date of Patent: *Jun. 19, 2001**

(54) INK CARTRIDGE INSERTION MECHANISM FOR INKJET PRINTER

(75) Inventor: Satoshi Iwaya, Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/140,730

(22) Filed: Aug. 24, 1998

(30) Foreign Application Priority Data

Aug. 28, 1997 (JP) ..... 9-232636

(51) Int. Cl.[7] ..... B41J 2/175
(52) U.S. Cl. ..... 347/86
(58) Field of Search ..... 347/84, 85, 86, 347/87, 49

(56) References Cited

U.S. PATENT DOCUMENTS

| | | | | |
|---|---|---|---|---|
| 4,074,284 | | 2/1978 | Dexter et al. | 347/49 |
| 4,162,501 | | 7/1979 | Mitchell et al. | 347/86 |
| 4,183,031 | * | 1/1980 | Kyser et al. | 347/86 |
| 4,700,202 | * | 10/1987 | Kuranishi et al. | 347/86 |
| 5,168,291 | | 12/1992 | Hiramatsu et al. | 347/19 |
| 5,500,664 | * | 3/1996 | Suzuki et al. | 347/86 |
| 5,627,570 | | 5/1997 | Hiramatsu et al. | 347/19 |
| 5,666,146 | | 9/1997 | Mochizuki et al. | 347/86 |

FOREIGN PATENT DOCUMENTS

| | | |
|---|---|---|
| 0 496 620 | 7/1992 | (EP) . |
| 0 699 532 | 3/1996 | (EP) . |
| 0 720 915 | 7/1996 | (EP) . |
| 4-1056 | 1/1992 | (JP) . |
| 5-16378 | 1/1993 | (JP) . |

* cited by examiner

*Primary Examiner*—N. Le
*Assistant Examiner*—Michael Nghiem

(57) ABSTRACT

An ink cartridge insertion mechanism for an ink jet printer capable of absorbing ink leaking from an ink supply needle after insertion thereof to an ink cartridge is provided. The ink supply unit of an ink jet printer has an ink absorption and needle protection mechanism 70 in which there is an ink absorption material 74 for absorbing ink leaking from the ink supply needle 31 and waste ink needle 35 of the ink supply unit when an ink cartridge is not installed. The ink absorption material 74 also protects the needles 31 and 35. When an ink cartridge is inserted, a pivot plate 73 causes the entire ink absorption and needle protection mechanism 70 to pivot away from the needles 31 and 35 to a retracted position, thus exposing the needles and preventing any interference with ink cartridge loading. When the ink cartridge is subsequently removed, torsion springs 75 and 76 urge the pivot plate 73 back to the original horizontal, ink absorption position.

18 Claims, 8 Drawing Sheets

INK CARTRIDGE INSERTION MECHANISM FOR INKJET PRINTER

BACKGROUND OF THE INVENTION

1. Field of the Invention

The present invention relates to an ink jet printer in which an ink cartridge is used as an ink reservoir from which ink is supplied for printing, and relates particularly to a mechanism for inserting an ink cartridge to such an ink jet printer.

2. Description of the Related Art

One common mechanism for inserting an ink cartridge to an ink jet printer ("ink cartridge insertion mechanism" below) requires sliding an ink cartridge into position on a holder such that an ink outlet piece in the ink cartridge is pierced though by an ink supply needle disposed in the ink cartridge holder of the ink jet printer.

An ink cartridge insertion mechanism of this type is disclosed in, for example, Japan Unexamined Patent Publication (kokai) H5-16378 (1993-16378), which was also filed by the present inventors. The ink cartridge used with the ink cartridge insertion mechanism disclosed in the cited publication comprises a flexible ink bag filled with ink, an ink outlet piece formed in the ink bag, and a rectangular, rigid plastic case for holding the ink bag. The ink outlet piece of the ink bag is exposed at one side, more specifically at the front end, of the plastic case. The ink cartridge is thus slid horizontally into the ink cartridge holder so that the ink supply needle in the holder is inserted to the ink outlet piece.

When an ink cartridge is not mounted on the holder with this type of ink cartridge insertion mechanism, the ink supply needle is exposed in the opening in the holder through which the ink cartridge is inserted.

A potential problem with this construction, however, is that exposure of the unprotected tip of the ink supply needle can be dangerous because the tip is typically sharp, and can also subject the needle to damage when something is dropped thereon from the insertion opening in the holder.

To prevent the above-noted problems, the above-cited document teaches an ink cartridge insertion mechanism having a shutter disposed to the ink cartridge holder. This shutter opens when an ink cartridge is inserted to the opening, and closes again when the ink cartridge holder is removed such that when the ink cartridge is not installed the shutter isolates and protects the ink supply needle.

Ink jet printers that supply ink from an ink cartridge to the ink jet head after the ink cartridge has been loaded with the ink supply needle on the holder inserted to the ink outlet piece of the cartridge are generally factory tested for normal printer operation by actually loading an ink cartridge and printing. When the printing test is completed, the ink cartridge is removed and printers that have passed the test are then shipped.

It will be obvious that this test method leaves an amount of ink in the ink supply path after the initial printing test. There is thus the possibility that this residual ink will leak from the tip of the ink supply needle during shipping. Such leakage can soil the area around the needle which is not desirable, and this soiling can lead to customer complaints.

There is therefore a need for an ink cartridge insertion mechanism for an ink jet printer whereby residual ink leaked from the ink supply needle when an ink cartridge is not installed can be collected.

There is a further need for an ink cartridge insertion mechanism for an ink jet printer whereby residual ink leaked from the ink supply needle when an ink cartridge is not installed can be collected, and the ink supply needle can also be protected.

OBJECTS OF THE INVENTION

Therefore, it is an object of the invention to overcome the aforementioned problems.

An object of the present invention is to provide an ink cartridge insertion mechanism for an ink jet printer wherein the ink cartridge insertion mechanism has a movable ink absorption member for absorbing ink leaking from an ink supply needle.

SUMMARY OF THE INVENTION

In accordance with an aspect of the present invention, an ink jet printer is provided in which the ink cartridge insertion mechanism is typically used commonly has an ink cartridge receiver to which an ink cartridge is installed by inserting the ink cartridge axially to an ink supply needle so that the ink supply needle is inserted to an ink outlet piece in the ink cartridge.

The ink absorption member of the ink cartridge insertion mechanism is normally held in an ink absorption position when an ink cartridge is not installed. When an ink cartridge is inserted and installed, the ink absorption member moves in conjunction with the ink cartridge insertion operation to a retracted position at which there is no interference with ink cartridge insertion.

With an ink cartridge insertion mechanism for an ink jet printer according to the present invention, the ink absorption member is positioned to absorb any ink that leaks from the ink supply needle whenever an ink cartridge is not installed in the printer. Ink leaking from the ink supply needle is thus collected by the ink absorption member, and the area around the ink supply needle will not be soiled by leaking ink. When an ink cartridge is inserted, the ink absorption member is moved in conjunction with ink cartridge insertion to a retracted position whereat the ink absorption member does not interfere with ink cartridge insertion. Providing an ink absorption member therefore does not create any inconvenience or problem with inserting and installing an ink cartridge.

The ink absorption member of the present invention is preferably also used as a means for protecting the ink supply needle so that the ink supply needle cannot be directly touched when an ink cartridge is not installed.

The ink absorption member further preferably comprises an ink absorption material and a pivot plate for supporting the ink absorption material. The pivot plate is pivotally mounted in the ink cartridge receiver so that it can pivot between the ink absorption position and the retracted position.

A spring is preferably provided there for applying a resilient force to the pivot plate as a means of constantly urging and holding the pivot plate to the ink absorption position. When an ink cartridge is inserted using an ink cartridge insertion mechanism thus comprised, the ink cartridge pushes the pivot plate against the force of the spring, and thereby moves the ink absorption material attached to the pivot plate to the retracted position.

The pivot plate further preferably has a slit through which the ink supply needle can pass when the pivot plate moves to the ink absorption position, and the ink absorption material is attached to a back side of the pivot plate. The ink absorption material also has a recessed channel at a position corresponding to the slit for accepting an ink supply needle passed through the slit.

When thus comprised, the ink supply needle is effectively protected from the outside by the pivot plate and ink absorption material when it is inserted to the recessed channel in the ink absorption material. As a result, the ink absorption material can both absorb any ink that leaks from the tip of the ink supply needle, and can protect the ink supply needle, when an ink cartridge is not installed.

To move the ink absorption member in conjunction with insertion of an ink cartridge, the pivot plate further preferably comprises at a leading edge thereof an engaging part that is pushed toward the retracted position by an ink cartridge when the ink cartridge is being inserted.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

An ink jet printer comprising an ink cartridge insertion mechanism according to the present invention is described next below with reference to the accompanying figures.

Overall Configuration of an Ink Jet Printer

Figure 1:
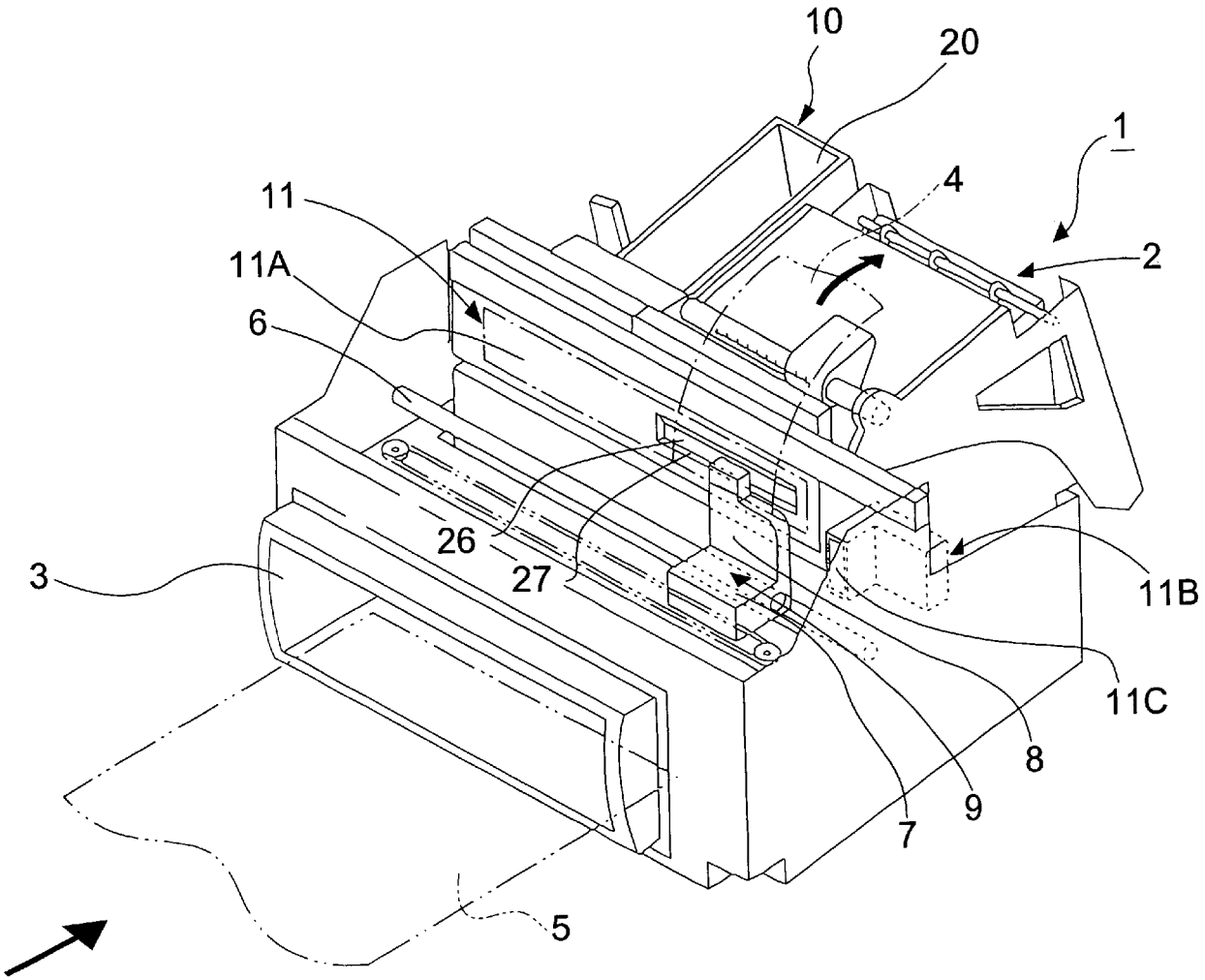
FIG. 1 is a perspective view as viewed from the front of an ink jet printer in which an ink cartridge insertion mechanism according to the present invention is used.
Figure 2:
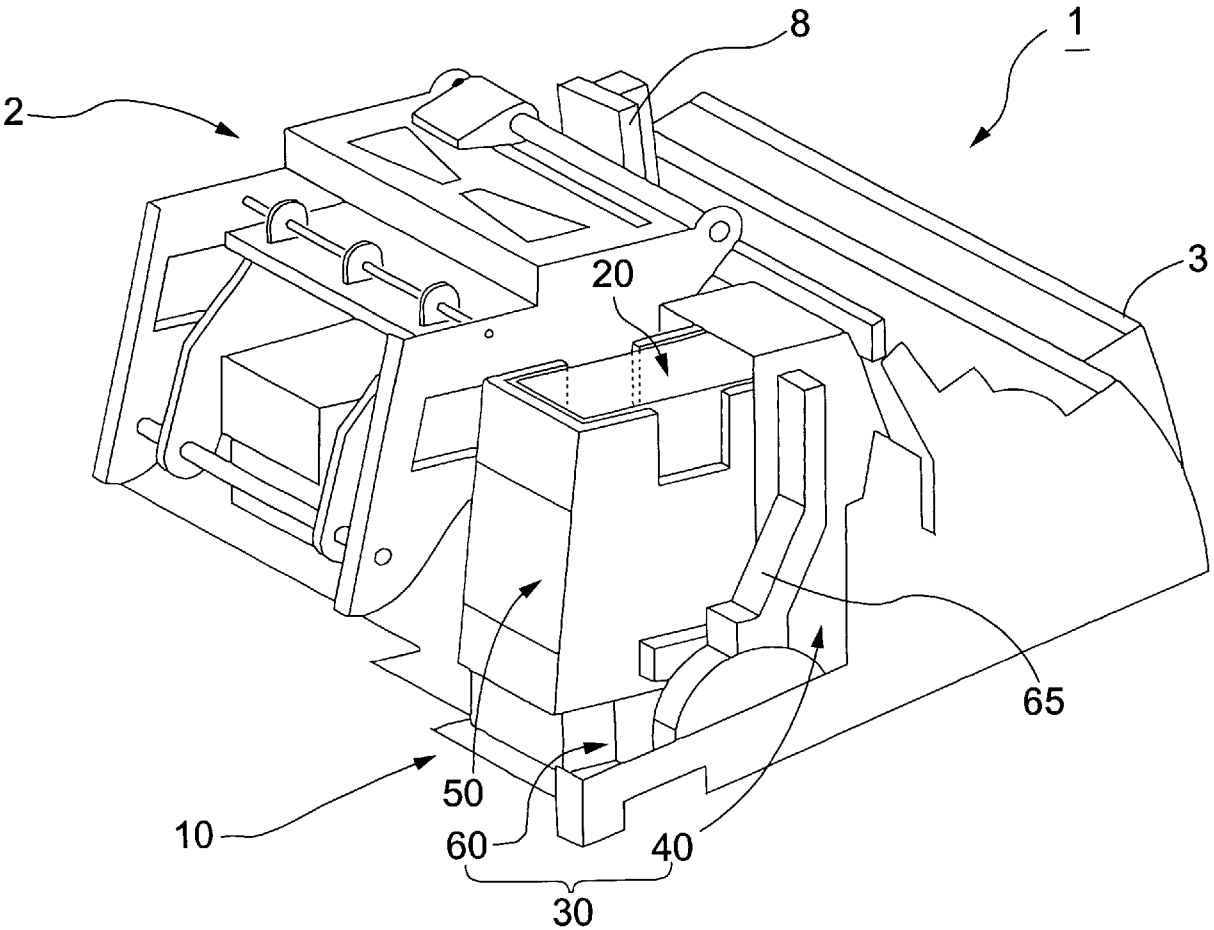
FIG. 2 is a perspective view as viewed from the back of the ink jet printer shown in FIG. 1.
Figure 3:
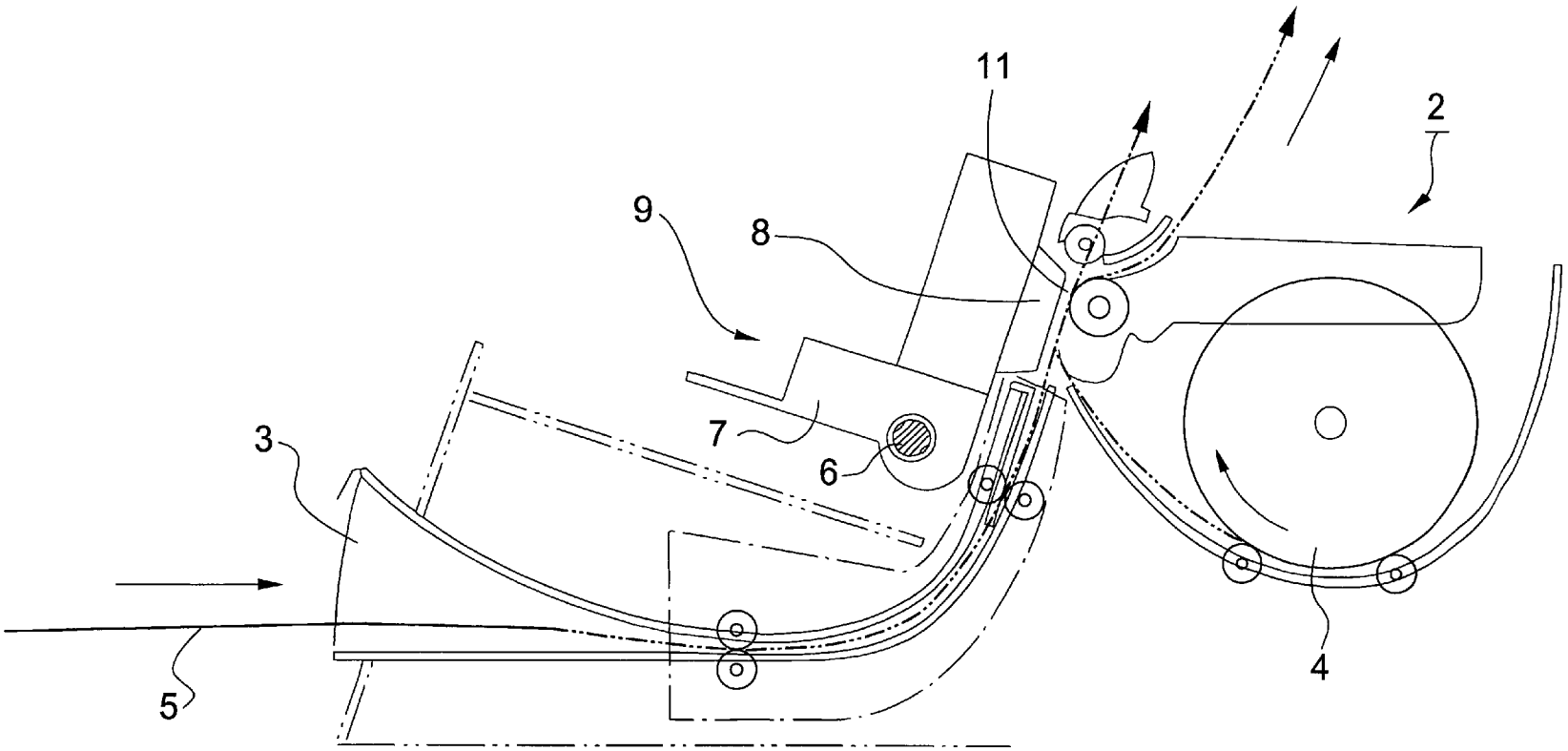
FIG. 3 is a side view of a typical paper transport path in the ink jet printer shown in FIG. 1.

FIG. 1 and FIG. 2 are perspective views from the front and back, respectively, of an ink jet printer comprising an ink cartridge insertion mechanism according to the present invention. FIG. 3 is a side cross-sectional view showing the major elements of the paper transport path in the ink jet printer shown in FIGS. 1 and 2.

As will be known from these figures, the transportation path of an ink jet printer 1 according to a preferred embodiment of the invention conducts the print medium from either a roll paper loading mechanism 2, or a paper supply opening 3, to the printing position 11 (indicated by a dot-dash line in FIG. 1). Roll paper 4 is supplied from the roll paper loading mechanism 2, and A4 paper or other size of cut sheet paper or slip form 5 is inserted from the paper supply opening 3. The ink jet head 8 is held on a carriage mechanism 9 in a position opposing the roll paper 4 or slip form 5 as it passes the printing position 11.

The carriage mechanism 9 comprises a guide shaft 6, a carriage 7, and a motor (not shown in the figures) for driving the carriage 7. The carriage 7 is held in a manner enabling a reciprocating movement along the guide shaft 6 in a direction orthogonal to the direction in which the roll paper 4 and slip form 5 are transported.

The carriage 7 can move widthwise in two directions through an area containing the printing position 11. The capping face 11C of a capping mechanism 11B is disposed at a position removed widthwise to one side of the printing position 11. The capping mechanism 11B is located at the position to which the ink jet head 8 is retracted. When the printer is in a standby mode between printing operations, the nozzles of the ink jet head 8 are effectively covered by the capping face 11C, thereby preventing the ink in the nozzles from drying.

Ink is supplied to the ink jet head 8 through an ink tube (not shown in the figures) from an ink supply unit 10, which is located beside the roll paper loading mechanism 2. As will be known from FIG. 2, the ink supply unit 10 has an ink cartridge loader (receiver) 30 for loading and holding a replaceable ink cartridge 20.

Ink Supply Path and Ink Cartridge

Figure 4B:
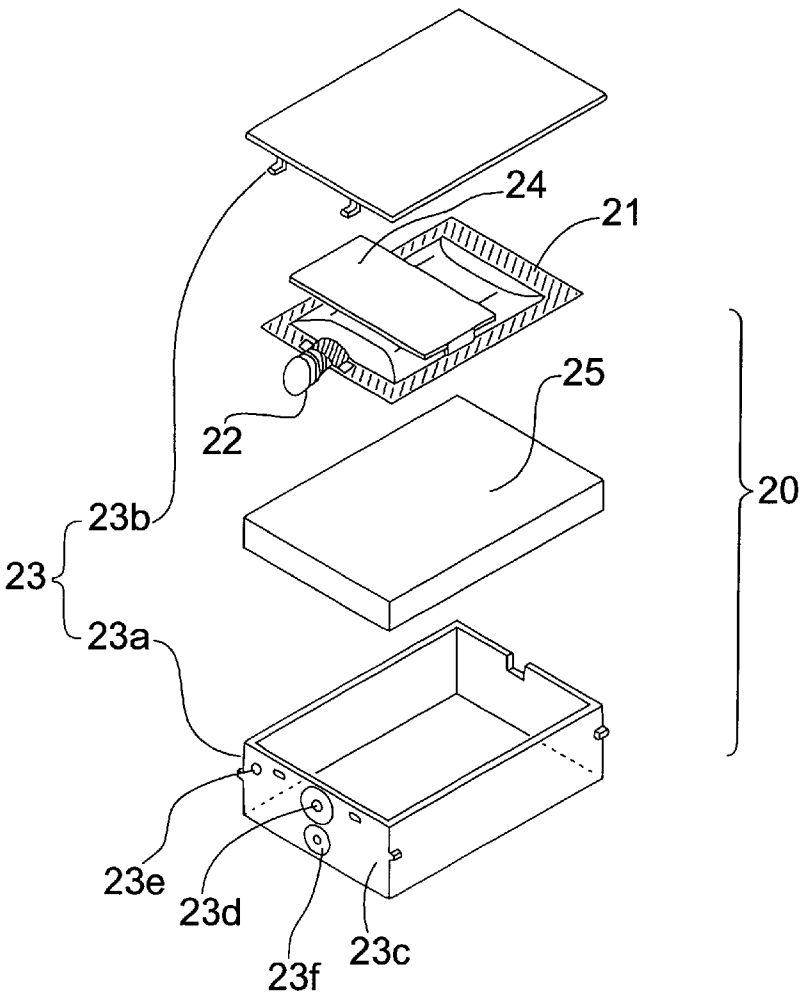
FIG. 4(B) is a partially exploded perspective view of an ink cartridge.
Figure 4A:
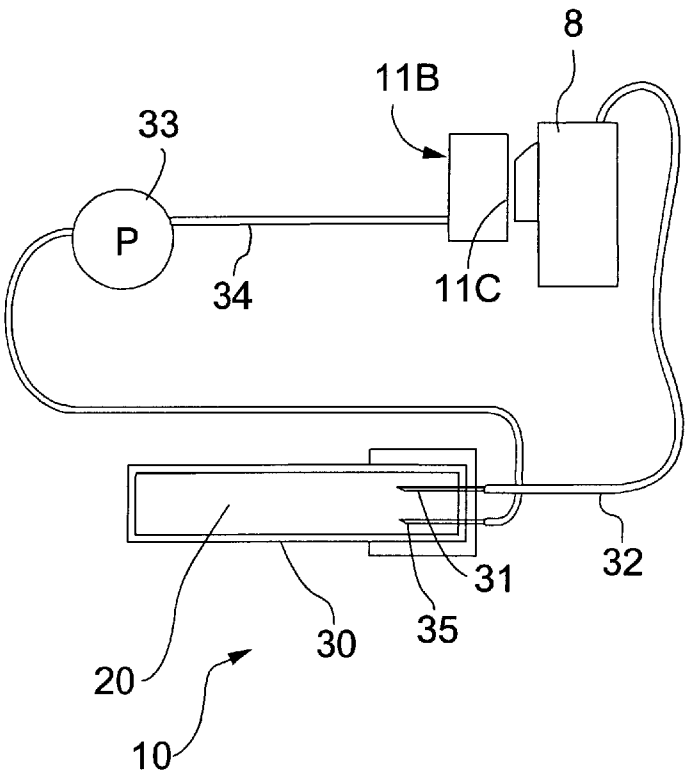
FIG. 4(A) is a typical view of the ink supply path in the ink jet printer shown in FIG. 1.

An outline of an ink supply path for supplying ink to the ink jet head 8 is shown in FIG. 4(A). An ink supply needle 31 and waste ink needle 35 are provided in the ink cartridge loader 30 of the ink supply unit 10. The ink cartridge 20 is installed so that the ink supply needle 31 and waste ink needle 35 are inserted completely into the ink cartridge 20. Ink is supplied from the ink cartridge 20 to the ink supply needle 31, passes through an ink tube 32, and is delivered to the ink jet head 8. The ink jet head 8 is then driven to eject ink drops from the ink nozzles (not shown in the figures) of the ink jet head 8 onto the surface of the printing paper or other medium transported to the printing position 11.

When the ink jet head 8 is covered by the capping face 11C of the capping mechanism 11B, an ink pump 33 is driven to suction ink from the nozzle for recovering the nozzle. The waste ink is collected through a waste ink tube 34 and waste ink needle 35 to a waste ink collection unit 25 (shown in FIG. 4(B)) inside the ink cartridge 20.

A typical view of the internal structure of an ink cartridge 20 is shown in FIG. 4(B). As shown in the figure, the ink cartridge 20 comprises a flexible ink bag 21 in which ink is sealed; a rigid case 23 inside of which is held the ink bag 21; and a waste ink collection unit 25 made from an ink absorbent material. An ink outlet piece 22 is also formed in the ink bag 21.

The rigid case 23 comprises a case body 23*a* and a case cover 23*b*. Two needle insertion holes 23*d* and 23*f*, and an ink cartridge positioning hole 23*e*, are provided in the front face 23*c* of the ink cartridge 20 as seen in FIG. 4(B). One needle insertion hole 23*d* is for inserting the ink supply needle 31 to the ink outlet piece 22 from outside the ink cartridge 20. The other needle insertion hole 23*f* is for inserting the waste ink needle 35 to an opening or an inlet piece(not shown in the figure) of the waste ink collection unit 25 from outside the ink cartridge 20. A detection plate 24 for detecting how much ink remains is attached to a side of the ink bag 21.

Ink Cartridge Insertion Mechanism

The structure of the ink supply unit 10 incorporated into the ink jet printer 1 is described next.

Figure 5A:
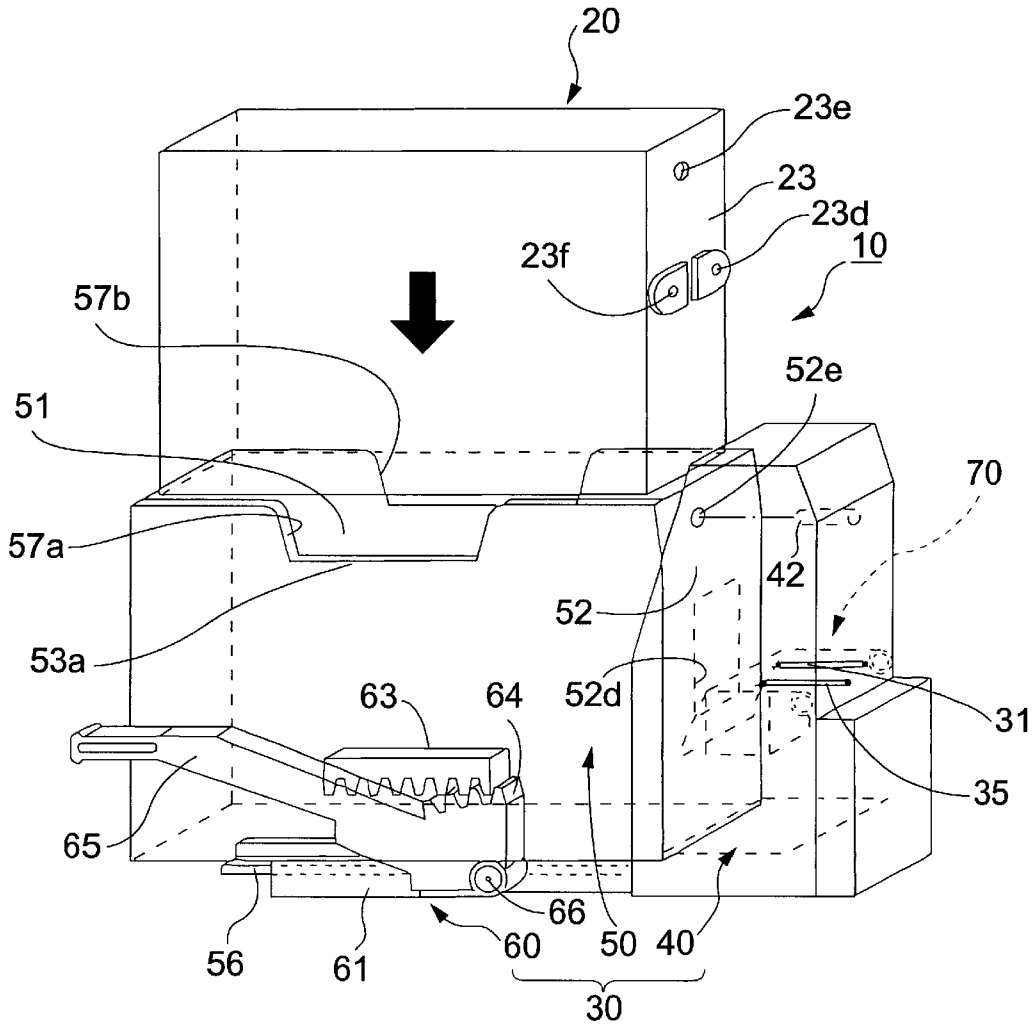
FIG. 5(A) is a transparent perspective view of the ink cartridge insertion mechanism before an ink cartridge is inserted to the ink cartridge holder, and FIG. 5 (B) is a partial cross-sectional view thereof.
Figure 6A:
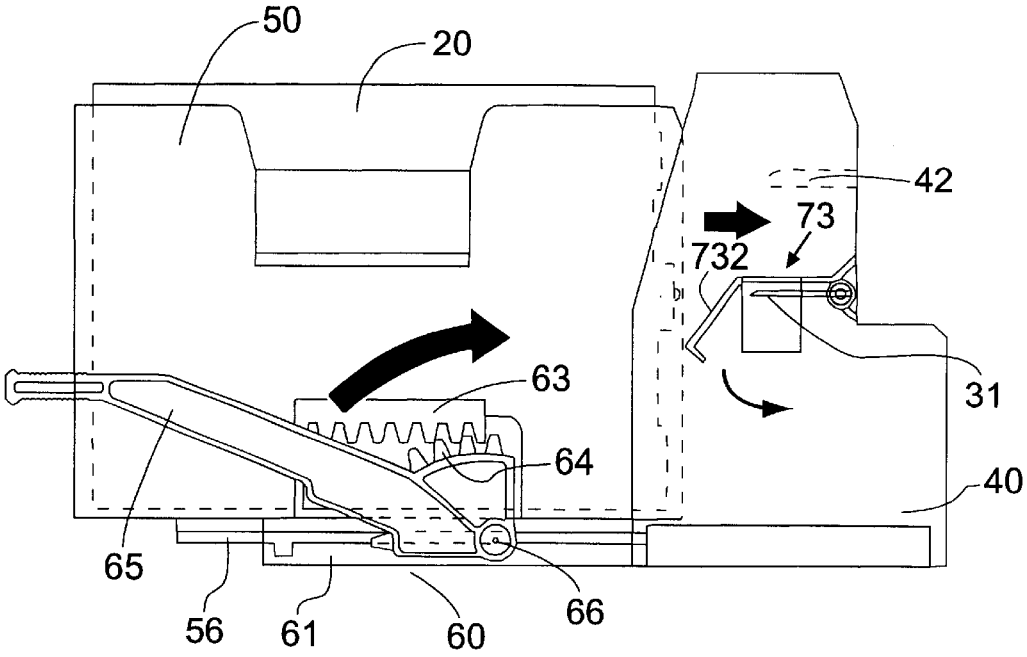
FIGS. 6(A) and 6(B) illustrate the ink cartridge insertion operation of the ink cartridge insertion mechanism shown in FIG. 5.
Figure 7A:
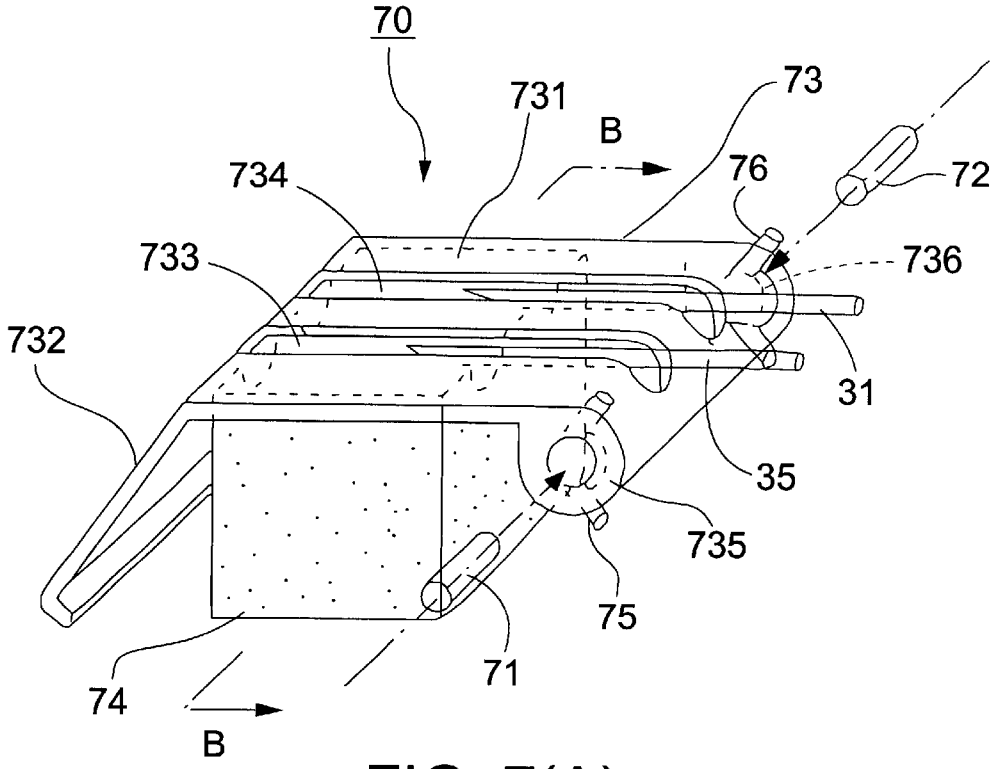
FIGS. 7(A) and 7(B) show the ink absorption and needle protection mechanism assembled in the ink cartridge insertion mechanism shown in FIG. 5, FIG. 7(A) being a perspective view thereof when in the ink absorption position, and FIG. 7(B) being a cross-sectional view taken along line B—B in FIG. 7(A)

The ink supply unit 10 before an ink cartridge 20 is installed thereto is shown in FIGS. 5(A) and (B). The ink supply unit 10 before and after an ink cartridge 20 is slid to the ink supply needle 31 and waste ink needle 35 using a sliding mechanism 60 is shown in FIGS. 6(A) and (B). An ink absorption and needle protection mechanism is shown in FIGS. 7(A) and (B).

As shown in the figures, the ink supply unit 10 comprises an ink cartridge loader 30 for holding a replaceable ink cartridge 20. The ink supply needle 31 and waste ink needle 35 are positioned horizontally as shown in the figure at the same height in the ink cartridge loader 30, and are enclosed in a hood 40 that is open on the open end side of the ink supply needle 31 and waste ink needle 35. An ink absorption and needle protection mechanism 70 is also contained within the hood 40.

The ink absorption and needle protection mechanism 70 protects the ink supply needle 31 and waste ink needle 35, and absorbs any ink that leaks from the needles when an ink cartridge is not installed.

The ink cartridge loader 30 also comprises a box-like ink cartridge holder 50 and a sliding mechanism 60. The ink cartridge holder 50 is disposed so that it can slide horizontally relative to the hood 40, that is, in the axial direction of the ink supply needle 31 and waste ink needle 35. The sliding mechanism 60 is used to slide the ink cartridge holder 50 horizontally. This box-like ink cartridge holder 50 is described first below.

The top of the ink cartridge holder 50 is an opening 51 enabling an ink cartridge 20 to be loaded from above into the ink cartridge holder 50. As a result, the ink cartridge 20 is inserted to the ink cartridge holder 50 from a direction substantially perpendicular to the axis of the ink supply needle 31.

An opening 52*d* is provided in the front face 52 of the ink cartridge holder 50 at a position corresponding to the needle insertion holes 23*d* and 23*f* in the front face 23*c* of an inserted ink cartridge 20. A positioning hole 52*e* likewise corresponding to the positioning hole 23*e* of the ink cartridge 20 is also provided.

The sliding mechanism 60 has a guide frame 61 on which the ink cartridge holder 50 is supported for sliding in two directions. A guide rail 56 formed along the bottom of the ink cartridge holder 50 fits into and slides inside a rail channel 62 formed in the guide frame 61. A rack 63 is formed facing downward as shown in FIG. 5A on the side of the ink cartridge holder 50. A pinion 64 engaging the rack 63 is formed on the side of the guide frame 61 in a manner enabling the pinion 64 to pivot freely. An operating lever 65 is formed on one side of the pinion 64 extending substantially radially from the rotational axis 66 of the pinion 64.

Ink Absorption and Needle Protection Mechanism

The ink absorption and needle protection mechanism 70 is described next referring primarily to FIGS. 7A, B and FIGS. 8A, B.

As shown in the figures, the ink absorption and needle protection mechanism 70 comprises a pivot plate 73, ink absorption material 74, and a pair of torsion springs 75 and 76.

The pivot plate 73 is disposed so that it can pivot freely on support pins 71 and 72 relative to the side walls of the hood 40. The ink absorption material 74 is a rectangular body affixed to the back (bottom) of the pivot plate 73 as seen in the figures. The springs 75 and 76 apply a resilient force to the pivot plate 73, and thus constantly urge the pivot plate 73 to assume a particular position.

The pivot plate 73 is made from a rigid material such as a metal plate or a hard plastic molding. The pivot plate 73 also comprises a horizontal part 731 and an inclined part 732. The horizontal part 731 is substantially horizontal when an ink cartridge is not installed. Inclined part 732 extends at a downward slope from the outside edge of the horizontal part 731.

Support pin sockets 735 and 736 are formed at the inside end of the pivot plate 73 on opposite sides of the horizontal part 731. The support pins 71 and 72 fit in the support pin sockets 735 and 736, and the pivot plate 73 is thus supported in a manner enabling it to pivot freely.

Slits 733 and 734 are formed in the horizontal part 731 of the pivot plate 73 at positions corresponding to the ink supply needle 31 and waste ink needle 35, and are each sufficiently wider than the outside diameter of the corresponding needle.

Recessed channels 741 and 742 with a substantially semicircular cross section are formed in the top of the ink absorption material 74 at positions corresponding to the slits 733 and 734. The width and depth of these recessed channels 741 and 742 are also sufficiently greater than the outside diameter of the corresponding ink supply needle 31 and waste ink needle 35. In an exemplary embodiment of the invention as shown in FIGS. 7A, B and FIGS. 8A, B, the channel width and slit width are the same, but the invention shall obviously not be so limited.

Figure 7B:
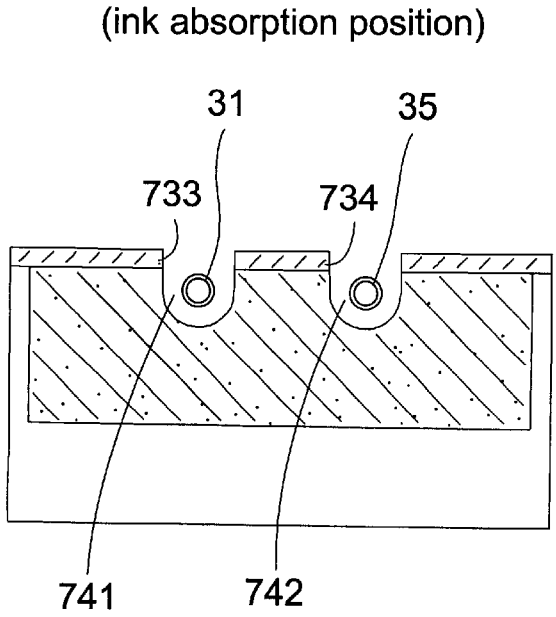

The pivot plate 73 is supported such that the horizontal part 731 is urged to a normally horizontal position by the pair of torsion springs 75 and 76. More specifically, the pivot plate 73 is supported such that the horizontal part 731 is parallel with the ink supply needle 31 and waste ink needle 35. The height of the pivot plate 73 is also set such that the ink supply needle 31 and waste ink needle 35 are completely received by the recessed channels 741 and 742 of the ink absorption material 74 as shown in FIG. 7(B). Note that the length of the slits 733 and 734 and the recessed channels 741 and 742 is also set so that the full length of the needles 31 and 35 can be received therein.

When the ink supply needle 31 and waste ink needle 35 are positioned in the slits 733 and 734 and the recessed channels 741 and 742 as shown in FIG. 7, ink leaking from either needle 31 or 35 will be absorbed and collected to the ink absorption material 74. As a result, the position of the pivot plate 73 when the horizontal part 731 thereof is horizontal and ink can be collected by the ink absorption material 74 is referred to below as the "ink absorption position."

Figure 8A:
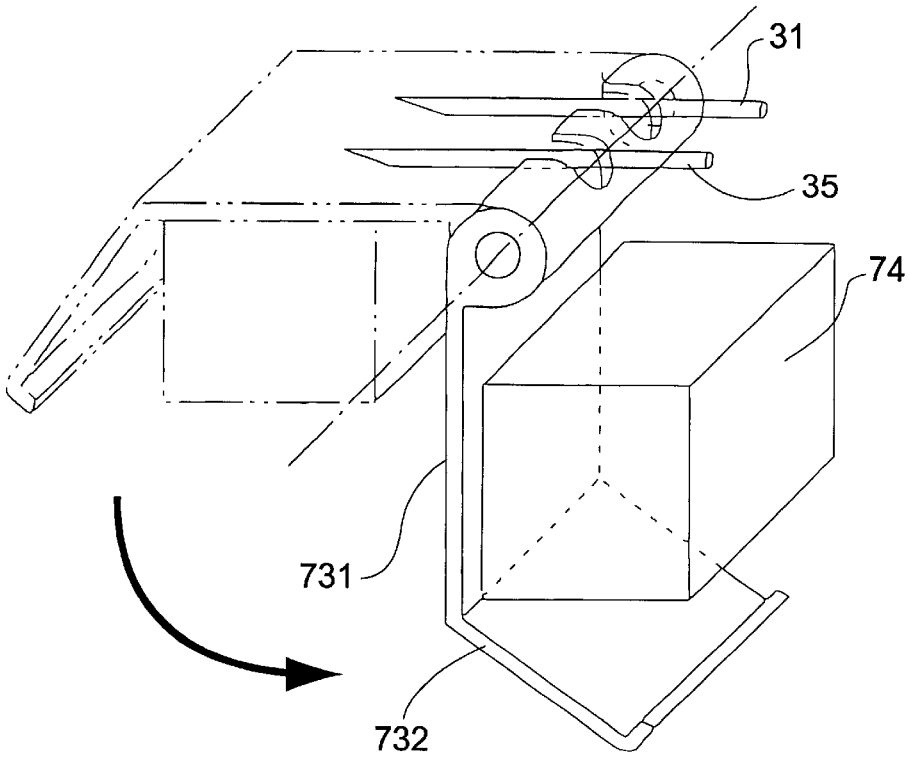
FIGS. 8(A) and 8(B) also show the ink absorption and needle protection mechanism shown in FIG. 7(A), FIG. 8(A) being an oblique view thereof when in the retracted position, and FIG. 8(B) being a front view thereof.
Figure 8B:
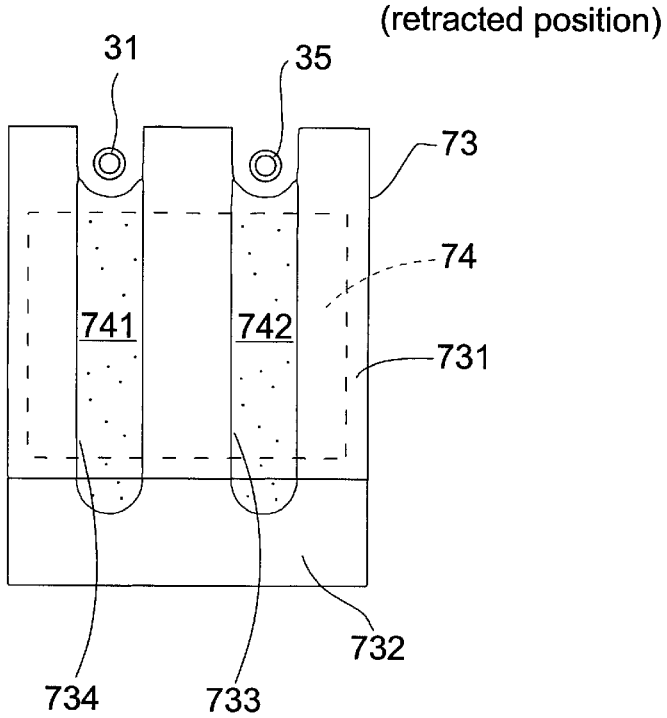

When the pivot plate 73 is pivoted downward against the tension of the springs 75 and 76 to the position indicated by the solid lines in FIG. 8A, the ends of the needles 31 and 35 are exposed and removed from the protective cover of the recessed channels 741 and 742 of the ink absorption material 74. As a result, the needles 31 and 35 can be inserted to the needle insertion holes 23*d* and 23*f* of the ink cartridge 20.

Yet more specifically, when the pivot plate 73 is pivoted to the downward position shown in FIG. 8A, the pivot plate 73 and ink absorption material 74 are moved to a "retracted position" at which they do not interfere with ink cartridge 20 installation.

Ink Cartridge Installation

Referring again to FIGS. 5A, B and FIGS. 6A, B, the operation whereby an ink cartridge 20 is loaded and inserted to an ink supply unit 10 according to the present embodiment is described next.

Figure 5B:
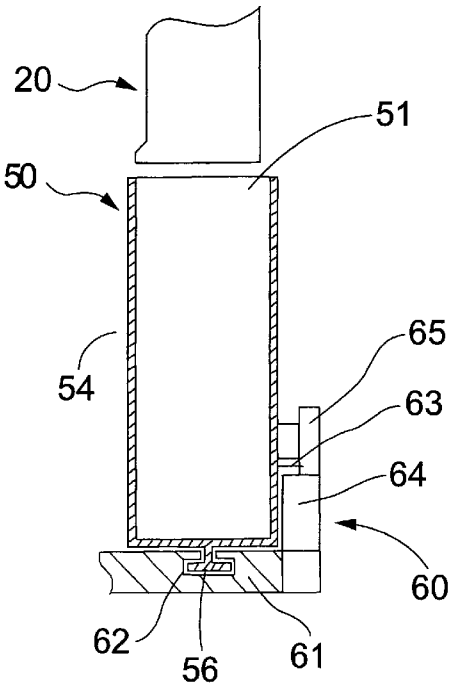

When the ink cartridge holder 50 is removed from the hood 40 as shown in FIGS. 5(A) and 5(B), an ink cartridge 20 can be inserted from above into the opening 51 as indicated by the arrow in FIG. 5(A). When the ink cartridge 20 is properly seated inside the ink cartridge holder 50, the needle insertion holes 23*d* and 23*f* and the positioning hole 23*e* in the front of the ink cartridge 20 as seen in FIG. 5A are aligned with the opening 52*d* and positioning hole 52*e* in the front of the ink cartridge holder 50.

The ink cartridge 20 and ink cartridge holder 50 are thus positioned as shown in FIG. 6(A) with the operating lever 65 in a substantially horizontal attitude. When the operating lever 65 is then lifted in the direction of the arrow, the pinion 64 rotates forward, driving the rack 63 and causing the ink cartridge holder 50 and the ink cartridge 20 held therein to slide horizontally towards the ink supply needle 31 and waste ink needle 35.

When the ink cartridge 20 and ink cartridge holder 50 are thus slid forward, the front face 52 of the ink cartridge holder 50 pushes on the inclined part 732 of the pivot plate 73 at the front of the ink absorption and needle protection mechanism 70. While the pivot plate 73 is normally urged by the torsion springs 75 and 76 to the horizontal ink absorption position (FIG. 7A), the downward inclination of the inclined part 732 forces the pivot plate 73 to pivot downward against the spring tension as it is pushed by the front face 52 of the ink cartridge holder 50.

Pivoting the pivot plate 73 thus exposes the ends of the ink supply needle 31 and waste ink needle 35, which are normally protected by the ink absorption material 74 and horizontal part 731 of the pivot plate 73. The needles 31 and 35 thus pass through the opening 52*d* in the front face 52 of the ink cartridge holder 50 as the ink cartridge holder 50 slides forward to the needles, and gradually penetrate the needle insertion holes 23*d* and 23*f* in the front of the ink cartridge 20.

Figure 6B:
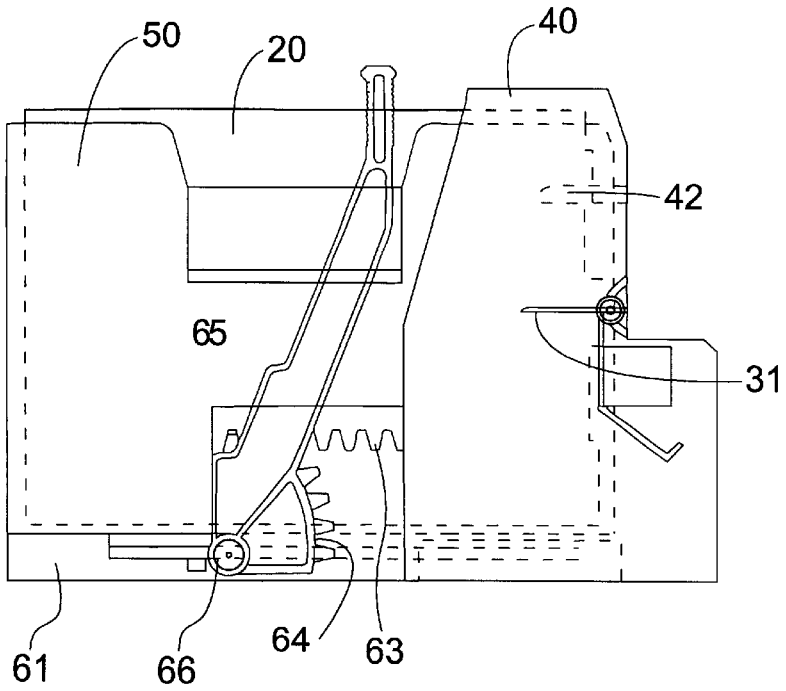

When the operating lever 65 has been completely raised to the vertical attitude shown in FIG. 6(B), the front face 52 of the ink cartridge holder 50 contacts a side of the hood 40, and the horizontal ink supply needle 31 and waste ink needle 35 are inserted completely through the opening 52*d* and needle insertion holes 23*d* and 23*f* to the inside ink outlet piece 22 and waste ink collection unit 25. As a result, the ink supply path from the ink cartridge 20 to the ink jet head 8 is completed as shown in FIG. 4A.

It should also be obvious that the ink cartridge 20 can be replaced with another ink cartridge 20 by simply reversing the above-described operation. That is, the operating lever 65 is simply rotated from the vertical position shown in FIG. 6 (B) to the horizontal position shown in FIG. 6(A). This causes the ink cartridge holder 50 to slide back and away from inside the hood 40, and exposes the top opening 51.

Sliding the ink cartridge holder 50 away from the needles also frees the inclined part 732 of the pivot plate 73, and enables the torsion springs 75 and 76 to urge the ink absorption and needle protection mechanism 70 back to the horizontal position. Sliding the ink cartridge holder 50 back thus allows the ink absorption and needle protection mechanism 70 to return to the ink absorption position whereat the needles 31 and 35 are protected as shown in FIG. 6(A).

The sides of the ink cartridge 20, which are exposed through cut-outs 57*a* and 57*b* in the sides of the ink cartridge holder 50, can then be simply held between the fingers and the ink cartridge 20 lifted up and out of the ink cartridge holder 50.

It will thus be obvious that the ink absorption and needle protection mechanism 70 for the ink supply unit 10 of an ink jet printer 1 according to the present invention protects the ink supply needle 31 and waste ink needle 35 from being accidentally touched when an ink cartridge is not installed while the ink absorption material thereof also absorbs ink leaking from said needles 31 and 35. It is therefore possible to prevent the area around the ink supply needle from becoming soiled by ink leaking from the ink supply needle during shipping of an ink jet printer.

As also described above, inserting an ink cartridge 20 causes the pivot plate 73 of the ink absorption and needle protection mechanism 70 to pivot to a retracted position whereat the ink absorption and needle protection mechanism 70 does not interfere with insertion and installation of an ink cartridge 20. It is therefore not necessary to provide a separate mechanism for moving the pivot plate 73 between an ink absorption position and a retracted position, and the ink absorption and needle protection mechanism 70 can be compactly disposed.

It will also be obvious that while the present invention has been described above with reference to an exemplary ink jet printer having both an ink supply needle and a waste ink needle, the invention shall not be so limited and can be applied to an ink jet printer having only an ink supply needle.

Furthermore, while the exemplary embodiment of the invention described above uses an ink cartridge loader to hold and slide the ink cartridge, it will also be obvious that the present invention can be similarly applied to an ink cartridge insertion mechanism whereby the ink cartridge itself is slid without using an ink cartridge loader.

Effects of the Invention

As described above, an ink cartridge insertion mechanism according to the present invention for use in an ink jet printer comprises a movable ink absorption member for absorbing ink leaking from the ink supply needle when an ink cartridge is not installed. It is therefore possible to avoid problems caused by leaked ink soiling the area around the needle.

As also described above, the ink absorption means moves automatically to a retracted position in conjunction with ink cartridge insertion. It is therefore not necessary to provide a separate means for moving the ink absorption member, and the ink absorption member can be comprised more compactly compared with an ink absorption member requiring a separate means of being moved. Ink cartridge insertion and removal are also made easier because a separate operation is not required to move the ink absorption member.

Yet further, the ink absorption member also functions as a means for protecting the ink supply needle when an ink cartridge is not installed. It is therefore possible to compactly dispose a mechanism having both an ink absorption function and a needle protection function.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

| Key to the figures | |
|---|---|
| 1 | ink jet printer |
| 2 | roll paper loading mechanism |
| 3 | paper supply opening |
| 4 | roll paper |
| 6 | guide shaft |
| 7 | carriage |
| 8 | ink jet head |
| 9 | carriage mechanism |
| 10 | ink cartridge loading mechanism |
| 11 | printing position |
| 20 | ink cartridge |
| 23d | ink supply needle insertion hole |
| 23f | waste ink needle insertion hole |
| 23e | positioning hole |
| 25 | waste ink collection unit |
| 30 | ink cartridge loader |
| 31 | ink supply needle |
| 35 | waste ink needle |
| 40 | hood |
| 42 | guide pin |
| 50 | ink cartridge holder |
| 51 | top opening |
| 52d | ink supply needle opening |
| 52e | positioning hole |
| 56 | guide rail |
| 60 | sliding mechanism |
| 61 | guide frame |
| 62 | rail channel |
| 63 | rack |
| 64 | pinion |
| 65 | operating lever |
| 70 | ink absorption and needle protection mechanism |
| 71, 72 | support pins |
| 73 | pivot plate |
| 731 | horizontal part |
| 732 | inclined part |
| 733, 734 | slits |
| 74 | ink absorption material |
| 741, 742 | recessed channels |
| 75, 76 | torsion springs |

What is claimed is:

1. An ink supply unit for accommodating an ink cartridge, comprising:

an ink cartridge receiver having an ink supply needle, the ink cartridge being insertable in said ink cartridge receiver in a direction axial to said ink supply needle so that said ink supply needle is insertable in an ink outlet piece of the ink cartridge; and a movable ink absorption member that is movably mounted in the ink cartridge receiver;

wherein said movable ink absorption member is disposed in an ink absorption position for absorbing ink leaking from said ink supply needle when the ink cartridge is absent from said ink cartridge receiver, wherein said ink absorption member includes a recess that prevents contact with said ink supply needle when said ink absorption member is disposed in said ink absorption position, and, wherein said movable ink absorption member is moved in conjunction with insertion of the ink cartridge to a retracted position at which there is an absence of interference with said ink supply needle for insertion into the ink outlet piece of the ink cartridge.

2. The ink supply unit according to claim 1, wherein said movable ink absorption member protects said ink supply needle when an ink cartridge is absent from said ink cartridge receiver and said movable ink absorption member is in the ink absorption position.

3. The ink supply unit according to claim 2, wherein said movable ink absorption member comprises:

an ink absorption material, and a pivot plate for supporting said ink absorption material, wherein said pivot plate is pivotally mounted in said ink cartridge receiver so as to pivot between the ink absorption position and the retracted position.

4. The ink supply unit according to claim 3, wherein said pivot plate has a slit through which said ink supply needle can pass when said pivot plate is disposed in the ink absorption position, and wherein the ink absorption material is attached to a back side of said pivot plate, and has a recessed channel at a position in correspondence with said slit for accepting said ink supply needle passing through said slit.

5. The ink supply unit according to claim 4, wherein said pivot plate comprises at a leading edge thereof an engaging part that is pushed toward the retracted position by the ink cartridge when the ink cartridge is being inserted.

6. An ink supply unit for accommodating an ink cartridge, comprising:

an ink cartridge receiver having an ink supply needle, the ink cartridge being insertable in said ink cartridge receiver in a direction axial to said ink supply needle so that said ink supply needle is insertable in an ink outlet piece of the ink cartridge; and a movable ink absorption member that is movably mounted in the ink cartridge receiver;

wherein said movable ink absorption member is disposed in an ink absorption position for absorbing ink leaking from said ink supply needle when the ink cartridge is absent from said ink cartridge receiver, and wherein said movable ink absorption member is moved in conjunction with insertion of the ink cartridge to a retracted position at which there is an absence of interference with said ink supply needle for insertion into the ink outlet piece of the ink cartridge, wherein said movable ink absorption member comprises:

an ink absorption material, and a pivot plate for supporting said ink absorption material, wherein said pivot plate is pivotally mounted in said ink cartridge receiver so as to pivot between the ink absorption position and the retracted position.

7. The ink supply unit according to claim 6, wherein said pivot plate has a slit through which said ink supply needle can pass when said pivot plate is disposed in the ink absorption position, and wherein the ink absorption material is attached to a back side of said pivot plate, and has a recessed channel at a position in correspondence with said slit for accepting said ink supply needle passing through said slit.

8. The ink supply unit according to claim 7, wherein said pivot plate comprises at a leading edge thereof a contacting part that is pushed toward the retracted position by the ink cartridge when the ink cartridge is being inserted.

9. A printer comprising:

a print head;

an ink cartridge in communication with said print head for accommodating ink and comprising an ink outlet piece;

an ink supply unit for accommodating said ink cartridge, said ink supply unit comprising:

an ink cartridge receiver having an ink supply needle, said ink cartridge being insertable in said ink cartridge receiver in a direction axial to said ink supply needle so that said ink supply needle is insertable in said ink outlet piece of said ink cartridge; and a movable ink absorption member that is movably mounted in said ink cartridge receiver;

wherein said movable ink absorption member is disposed in an ink absorption position for absorbing ink leaking from said ink supply needle when said ink cartridge is absent from said ink cartridge receiver, wherein said ink absorption member includes a recess that prevents contact with said ink supply needle when said ink absorption member is disposed in said ink absorption position, wherein said movable ink absorption member is moved in conjunction with insertion of the said cartridge to a retracted position at which there is an absence of interference with said ink supply needle for insertion into said ink outlet piece of the ink cartridge, and wherein when said ink cartridge is inserted in said ink cartridge receiver and said ink supply needle is inserted in said ink outlet piece, ink is supplied to said print head.

10. A printer comprising:

a print head;

an ink cartridge in communication with said print head to accommodate ink, said ink cartridge comprising an ink outlet piece;

an ink supply unit to accommodate said ink cartridge, said ink supply unit comprising:

an ink cartridge receiver having an ink supply needle, said ink cartridge being insertable in said ink cartridge receiver in a direction axial to said ink supply needle so that said ink supply needle is insertable in said ink outlet piece of said ink cartridge; and a movable ink absorption member movably mounted in said ink cartridge receiver;

wherein said movable ink absorption member is disposed in an ink absorption position for absorbing ink leaking from said ink supply needle when said ink cartridge is absent from said ink cartridge receiver, wherein said movable ink absorption member is moved in conjunction with insertion of the said cartridge to a retracted position at which there is an absence of interference with said ink supply needle for insertion into said ink outlet piece of the ink cartridge, wherein when said ink cartridge is inserted in said ink cartridge receiver and said ink supply needle is inserted in said ink outlet piece, ink is supplied to said print head, and wherein said movable ink absorption member comprises:

an ink absorption material, and a pivot plate for supporting said ink absorption material, wherein said pivot plate is pivotally mounted in said ink cartridge receiver so as to pivot between the ink absorption position and the retracted position.

11. The printer according to claim 10, wherein said pivot plate has a slit through which said ink supply needle can pass when said pivot plate is disposed in the ink absorption position, and wherein the ink absorption material is attached to a back side of said pivot plate, and has a recessed channel at a position in correspondence with said slit for accepting said ink supply needle passing through said slit.

12. The printer according to claim 11, wherein said pivot plate comprises at a leading edge thereof a contacting part that is pushed toward the retracted position by the ink cartridge when the ink cartridge is being inserted.

13. An ink supply unit for accommodating an ink cartridge, comprising:

an ink cartridge receiver having an ink supply needle, the ink cartridge being insertable in said ink cartridge receiver in a direction axial to said ink supply needle so that said ink supply needle is insertable in an ink outlet piece of the ink cartridge; and a movable ink absorption member that is movably mounted in the ink cartridge receiver;

wherein said movable ink absorption member is disposed in an ink absorption position for absorbing ink leaking from said ink supply needle when the ink cartridge is absent from said ink cartridge receiver, and wherein said movable ink absorption member is moved in conjunction with insertion of the ink cartridge to a retracted position at which there is an absence of interference with said ink supply needle for insertion into the ink outlet piece of the ink cartridge, wherein said movable ink absorption member comprises:

an ink absorption material, and a support for supporting said ink absorption material, wherein said support is mounted in said ink cartridge receiver so as to move between the ink absorption position and the retracted position.

14. The ink supply unit according to claim 13, wherein said support has a slit through which said ink supply needle can pass when said support is disposed in the ink absorption position, and wherein the ink absorption material is attached to a back side of said support, and has a recessed channel at a position in correspondence with said slit for accepting said ink supply needle passing through said slit.

15. The ink supply unit according to claim 14, wherein said support comprises at a leading edge thereof a contacting part that is pushed toward the retracted position by the ink cartridge when the ink cartridge is being inserted.

16. A printer comprising:

a print head;

an ink cartridge in communication with said print head to accommodate ink, said ink cartridge comprising an ink outlet piece;

an ink supply unit to accommodate said ink cartridge, said ink supply unit comprising:

an ink cartridge receiver having an ink supply needle, said ink cartridge being insertable in said ink cartridge receiver in a direction axial to said ink supply needle so that said ink supply needle is insertable in said ink outlet piece of said ink cartridge; and a movable ink absorption member movably mounted in said ink cartridge receiver;

wherein said movable ink absorption member is disposed in an ink absorption position for absorbing ink leaking from said ink supply needle when said ink cartridge is absent from said ink cartridge receiver, wherein said movable ink absorption member is moved in conjunction with insertion of the said cartridge to a retracted position at which there is an absence of interference with said ink supply needle for insertion into said ink outlet piece of the ink cartridge, wherein when said ink cartridge is inserted in said ink cartridge receiver and said ink supply needle is inserted in said ink outlet piece, ink is supplied to said print head, and wherein said movable ink absorption member comprises:

an ink absorption material, and a support for supporting said ink absorption material, wherein said support is mounted in said ink cartridge receiver so as to move between the ink absorption position and the retracted position.

17. The printer according to claim 16, wherein said support has a slit through which said ink supply needle can pass when said support is disposed in the ink absorption position, and wherein the ink absorption material is attached to a back side of said support, and has a recessed channel at a position in correspondence with said slit for accepting said ink supply needle passing through said slit.

18. The printer according to claim 17, wherein said support comprises at a leading edge thereof a contacting part that is pushed toward the retracted position by the ink cartridge when the ink cartridge is being inserted.

* * * * *